US006963707B2

(12) United States Patent
Kinoshita et al.

(10) Patent No.: US 6,963,707 B2
(45) Date of Patent: Nov. 8, 2005

(54) IMAGE FORMING APPARATUS INCLUDING FIRST AND SECOND AUXILIARY RESIDUAL DEVELOPER CHARGING FEATURES

(75) Inventors: Masahide Kinoshita, Mishima (JP); Masaki Ojima, Mishima (JP); Motoki Adachi, Numazu (JP); Masao Uyama, Mishima (JP); Kazuhiro Okubo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 10/664,896

(22) Filed: Sep. 22, 2003

(65) Prior Publication Data

US 2004/0136749 A1 Jul. 15, 2004

(30) Foreign Application Priority Data

Sep. 24, 2002 (JP) ..... 2002/278182

(51) Int. Cl.[7] ..... G03G 21/00
(52) U.S. Cl. ..... 399/129; 399/343
(58) Field of Search ..... 399/127, 129, 399/302, 308, 343, 344, 353

(56) References Cited

U.S. PATENT DOCUMENTS

| | | | | |
|---|---|---|---|---|
| 4,851,960 | A | 7/1989 | Nakamura et al. | 361/225 |
| 5,353,104 | A | 10/1994 | Kato et al. | 355/259 |
| 5,570,166 | A | 10/1996 | Ohzeki et al. | 355/251 |
| RE35,581 | E | 8/1997 | Nakamura et al. | 361/225 |
| 6,421,512 | B2 | 7/2002 | Watanabe et al. | 399/149 |
| 2003/0077088 | A1 | 4/2003 | Adachi et al. | 399/129 |
| 2004/0086297 | A1 * | 5/2004 | Watanabe | 399/129 |

FOREIGN PATENT DOCUMENTS

| | | |
|---|---|---|
| JP | 63-149669 | 6/1988 |
| JP | 2000-215798 | 8/2000 |

* cited by examiner

*Primary Examiner*—Hoan Tran
(74) *Attorney, Agent, or Firm*—Fitzpatrick, Cella, Harper & Scinto

(57) ABSTRACT

An image forming apparatus includes a photosensitive drum, a charge roller for charging the photosensitive drum, a developing device for developing an electrostatic latent image formed on the charged photosensitive drum with a developer, a first auxiliary charging brush which is located upstream from the charge roller in a movement direction of a surface of the photosensitive drum and applies a voltage of a polarity opposite to a normal polarity of a polarity opposite to a normal polarity of the developer, and a second auxiliary charging brush which is located downstream from the first auxiliary charging brush and upstream from the charge roller and applies a voltage of a polarity identical to the normal polarity of the developer. In the image forming apparatus, the first auxiliary charging brush is supplied with an AC voltage to be improved in recovery performance of a transfer residual developer, and contamination of charging means can be prevented.

21 Claims, 4 Drawing Sheets

IMAGE FORMING APPARATUS INCLUDING FIRST AND SECOND AUXILIARY RESIDUAL DEVELOPER CHARGING FEATURES

FIELD OF THE INVENTION AND RELATED ART

The present invention relates to an electro-photographic image forming apparatus, such as a copying machine, a printer or a facsimile machine. More specifically, the present invention relates to an image forming apparatus including an image bearing member; charging means for charging the image bearing member; first auxiliary charging means, for charging a developer on the image bearing member, disposed upstream from the charging means, in a movement direction of a surface of the image bearing member; and second auxiliary charging means, for charging the developer, disposed downstream from the first auxiliary charging means and upstream from the charging means in the movement direction of the surface of the image bearing member.

Conventionally, an image forming apparatus of a transfer type, such as a copying machine, a printer, a facsimile machine, or the like, which employs a transfer type electrophotographic recording system comprises: an electrophotographic photosensitive member as an image bearing member, which is generally in the form of a rotatable drum; a charging apparatus (charging process) for uniformly charging the photosensitive member to a predetermined polarity and a predetermined potential level; an exposing apparatus (exposing process), as an information writing means, for forming an electrostatic latent image on the uniformly charged photosensitive member; a developing apparatus (developing process) for developing the electrostatic latent image formed on the photosensitive member, into a developer image (toner image), or a visual image, with the use of toner, that is, developer; a transferring apparatus (transferring process) for transferring the toner image from the surface of the photosensitive member onto transfer medium (material) such as paper; a cleaning apparatus (cleaning process) for cleaning the surface of the photosensitive member by removing the developer ((transfer) residual toner) remaining, although only in a small amount, on the photosensitive member after the transfer process; a fixing apparatus (fixing process) for fixing the toner image on the transfer medium; and the like. The photosensitive member is repeatedly subjected to electrophotographic process (charging, exposing, developing, transferring, and cleaning processes) to form an image.

Generally, the cleaning apparatus includes therein a waste toner recovery container for containing the transfer residual toner which has been removed from the surface of the photosensitive member. Accordingly, in order to provide an image forming apparatus with a prolonged life of durability, the recovery container is required to be increased in size, thus being disadvantages in terms of size reduction of the apparatus.

In view of this disadvantage, a cleaner-less type image forming apparatus which lacks the cleaning apparatus including therein the waste toner recovery container, and in which the transfer residual toner remaining on the photosensitive member after the transfer process is removed and recovered into the developing apparatus to be used again through a simultaneous developing and cleaning method.

More specifically, the simultaneous developing and cleaning method is a method wherein the transfer residual toner presented on the photosensitive member, after the transfer process, across the areas (non-exposure or non-image portions) which are not to be developed with toner, is recovered into the developing apparatus by a fog removal bias (difference Vback in potential level between the DC voltage applied to the developing apparatus and the surface voltage on the surface of the photosensitive member) during the developing process on and after the following image forming process, i.e., during the developing process wherein the photosensitive member with the transfer residual toner is successively charged, and exposed, to form a subsequent electrostatic latent image, and the latent image is developed.

According to this method, the transfer residual toner is recovered into the developing apparatus and re-used to develop the electrostatic latent image on and after the following image forming process. Therefore, no toner will be wasted, reducing the amount of the bothersome work of maintenance. In addition, no waste toner container is also advantageous in reducing the size of the image forming apparatus.

On the other hand, as the charging means, a roller charging method using an electroconductive roller as a contact charging member is particularly preferably used in terms of charge stability in recent years instead of the corona charger. In the roller charging method, an elastic conductive roller (charge roller) is pressed against a member to be charged and a voltage is applied to the charge roller to effect charge treatment of the member to be charged.

With respect to this charging method, an AC charging method wherein a superposition voltage comprising DC voltage, corresponding to a predetermined surface potential Vd o the member to be changed, being superposed with an AC voltage component having a peak-to-peak voltage of not less than 2 ×Vth (discharged initiation voltage) is applied to the contact charging member has been proposed in, e.g., Japanese Laid-Open Patent Application (JP-A) Sho 63-149669. This AC charging method has also been put into practical use. By the potential averaging effect of the AC voltage, a degree of uniformization of charging can be further enhanced compared with the DC charging method. The potential of the member to be charged converges to Vd which is a center value of the peak voltage value of the AC voltage.

In the cleaner-less-type image forming apparatus wherein the transfer residual toner on the photosensitive member after the transfer process is removed and recovered into the developing apparatus by the simultaneous developing and cleaning method, in the case where the above-mentioned contact charging apparatus is used as the charging apparatus for the photosensitive member, the toner particularly (reversely) charged to a charge polarity opposite to its normal polarity, within the transfer residual toner, attaches to the contact charging apparatus to unacceptably contaminate the contact charging apparatus, thus causing charge failure in same cases.

This may be attributable to the co-presence of such toner components, although only in a small amount, that the charge polarity is originally reversed into a polarity opposite to the normal polarity, the charge polarity is reversed by being adversely affected by the transfer bias voltage or peeling discharge even in the case of the normal-polarity toner and the charge amount is reduced by charge removal.

More specifically, the transfer residual toner includes the normal-polarity toner component, the reverse-polarity toner component (reversed toner), and the less-charged toner in mixture. Of these toner components, the reversed toner or the less-charged toner is liable to adhere to the contact charging apparatus at the time of passing through the charging portion being the contact nip portion between the photosensitive member and the contact charging apparatus.

Further, in order to remove and recover the transfer residual toner remaining on the photosensitive member by the simultaneous developing and cleaning method, it is necessary that the charge polarity of the transfer residual toner on the photosensitive member carried to the developing station through the charging station is the normal polarity and the charge amount of the transfer residual toner is such that it allows development of the electrostatic latent image on the photosensitive member by the developing apparatus. With respect to the reversed toner or the toner a charge amount of which is not appropriate, the toner cannot removed and recovered into the developing apparatus, thus leading to image failure in some cases.

For this reason, it has been proposed, as described in JP-A 2000-215798, an image forming apparatus including a residual developer uniformization means (first auxiliary charging means) disposed downstream from a transfer station in a rotational direction of a photosensitive member and a developer charge amount control means (second auxiliary charging means) disposed downstream from the first auxiliary charging means and upstream from charging means for charging the photosensitive member.

In this image forming apparatus, the first auxiliary charging means is means for dispersing and distributing a pattern-like transfer residual toner image carried from the transfer station to the second auxiliary charging means over the surface of the photosensitive member to break the pattern of transfer residual toner image. More specifically, the transfer residual toner image pattern is scraped or disturbed by rubbing the surface of the photosensitive member with a rubbing member to cause the developer to be dispersed and distributed over the photosensitive member surface.

By provision of the first auxiliary charging means, the charge treatment of normal polarity for the entire transfer residual toner by the second auxiliary charging means supplied with a subsequent normal polarity voltage can always be well performed, thus effectively preventing adhesion of the transfer residual toner to the charging means. Further, the transfer residual toner image pattern is erased to prevent an occurrence of a ghost image of the transfer residual toner image pattern.

More specifically, in the case of no first auxiliary charging means, when a transferability o the toner image is poor due to factors, such as a vertical line pattern developer image, environment, the kind of paper (image receiving member), and secondary color portion where a multitude of toner images superposed (e.g., a portion at which a color image of red or orange is formed by disposing yellow and magenta toners in a superposition manner), the amount of the pattern-like image transfer residual toner on the photosensitive member is increased. The transfer residual toner image is carried to the second auxiliary charging means as it is, so that the developer concentrates at a part of the second auxiliary charging means, thus causing such a phenomenon (toner charge failure phenomenon) that the charge amount of the transfer residual toner is out of control at the part of the second auxiliary charging means. As a result, charge failure is caused to occur by contamination of the charging member, or the transfer residual toner image pattern is left to cause an occurrence of its ghost image.

By providing the first auxiliary charging means, as described above, the developer of the pattern-like transfer residual toner image borne on the image bearing member to be carried from the transfer station to the second auxiliary charging means is dispersed or distributed over the photosensitive member surface even in a large amount to break its pattern. As a result, concentration of the developer at the part of the second auxiliary charging means is obviated, and a sufficient charge treatment of the normal polarity is well performed to the entire transfer residual toner by the second auxiliary charging means to effectively prevent the adhesion of the transfer residual toner to the charging means. Further, the occurrence of the ghost image for the transfer residual toner image pattern is severely suppressed.

Further, the charge amount of the transfer residual toner charge-treated into the normal polarity by the second auxiliary charging means is appropriately controlled so that the photosensitive member is charged to a predetermined potential by the charging means and the electrostatic latent image on the photosensitive member is developed by the developing apparatus. As a result, the recovery of the transfer residual toner into the developing apparatus is performed efficiently to attain a good image free from ghost or charge failure.

However, in the case of employing the conventional cleaner-less systems, the following problems have arisen.

(1) In the case where the image forming apparatus is stopped in such a state that a toner adhered to the photosensitive member due to paper jamming or sudden power failure during image formation is sent to the transfer station, an abnormal image due to charge failure is generated when the following image formation is performed.

(2) In the case where a plurality of image forming units (process units) each including a photosensitive member, a developing apparatus, a charging means, a first auxiliary charging means, and a second auxiliary charging means are arranged for image formation of yellow, magenta, cyan and black, and then four color toner images are successively transferred onto an image receiving member, i.e., image formation is performed by a so-called serially-arranged four full-color printers, when a printing operation is performed in such a state that a printing rate of an image forming station located downstream in a movement direction of the image receiving member or the intermediary transfer member (hereinafter, referred to as "downstream station") is lower than that of an image forming station located upstream in the movement direction (hereinafter, referred to as "upstream station"), the color (hue) at the downstream station is changed.

The causes of the above problems (1) and (2) may be considered as follows.

With respect to the problem (1), in the case where the image forming apparatus is interrupted due to the paper jamming or the sudden power failure in such a state that the toner image is adhered to the photosensitive member surface in the developing process and transferred to the transfer station, when the photosensitive member is rotated at the time of a subsequent image forming operation, the toner located at the transfer portion is not transferred but is sent to the abutting portion between the first auxiliary charging means and the photosensitive member. At this time, an amount of toner after the transfer process is larger than an ordinary amount of the transfer residual toner, so that the charging of the toner layer to the normal polarity by the second auxiliary charging means is performed only at its surface portion due to excessive toner layer thickness even when charge uniformization is performed by the first auxiliary charging means disposed upstream from the second auxiliary charging means in the rotational direction of the photosensitive member, thus failing to be sufficiently performed at a portion of the toner layer closer to the underlying photosensitive member. As a result, onto the surface of the charging means, the transfer residual toner after passing through the second auxiliary charging means is adhered, thus causing an occurrence of abnormal image due to the charge failure.

With respect to the problem (2), when the transfer operation at the downstream station is performed in such a state that the image at the upstream station is placed on the image receiving member or the intermediary transfer member in the case of successively performing transfer operation at the respective stations, the toner originally placed on the intermediary transfer member at the upstream station is adhered to the photosensitive member, although in a very small amount, at the downstream station (referred to as a "re-transfer phenomenon"). The toner which has been re-transferred at the downstream station is also recovered into the developing apparatus by being uniformly charged to the normal polarity through the second auxiliary charging means and being controlled to have an appropriate charge amount (capable of developing the electrostatic latent image on the photosensitive member) through the charging means. Therefore, in the case where the printing rate at the upstream station is re-transferred at the downstream station when the image formation is successively performed, thus gradually entering the developing apparatus. The color of the resultant toner image is not so changed in a smaller amount of the re-transferred toner, but the toner-entering the developing apparatus due to the re-transfer phenomenon is gradually accumulated when the formation of the image having a printing rate, at the downstream station, lower than that at the upstream station is successively performed, thus causing a change in coloring due to color mixing.

SUMMARY OF THE INVENTION

In view of the above-mentioned problems, an object of the present invention is to provide an image forming apparatus improved in recovery performance of a transfer residual toner at a first auxiliary charging means.

Another object of the present invention is to prevent adhesion of the transfer residual toner which cannot be recovered by the first auxiliary charging means to a charging means when an amount of the transfer residual toner is increased.

Another object of the present invention is to prevent an occurrence of a ghost image on an image bearing member.

Another object of the present invention is to provide an image forming apparatus, capable of forming a multi-color image at a plurality of image forming stations, which can prevent a change in color of a resultant image due to color mixing caused by inclusion of a developer from an upstream-side image forming station into a developing apparatus of a downstream-side image forming station through re-transfer when, e.g., an image having a printing rate on the upstream side in a movement direction of a transfer medium is higher than that on the downstream side.

DESCRIPTION OF THE PREFERRED EMBODIMENTS

Hereinbelow, the image forming apparatus according to the present invention will be described more specifically based on the drawings.

(Embodiment 1)

Figure 1:
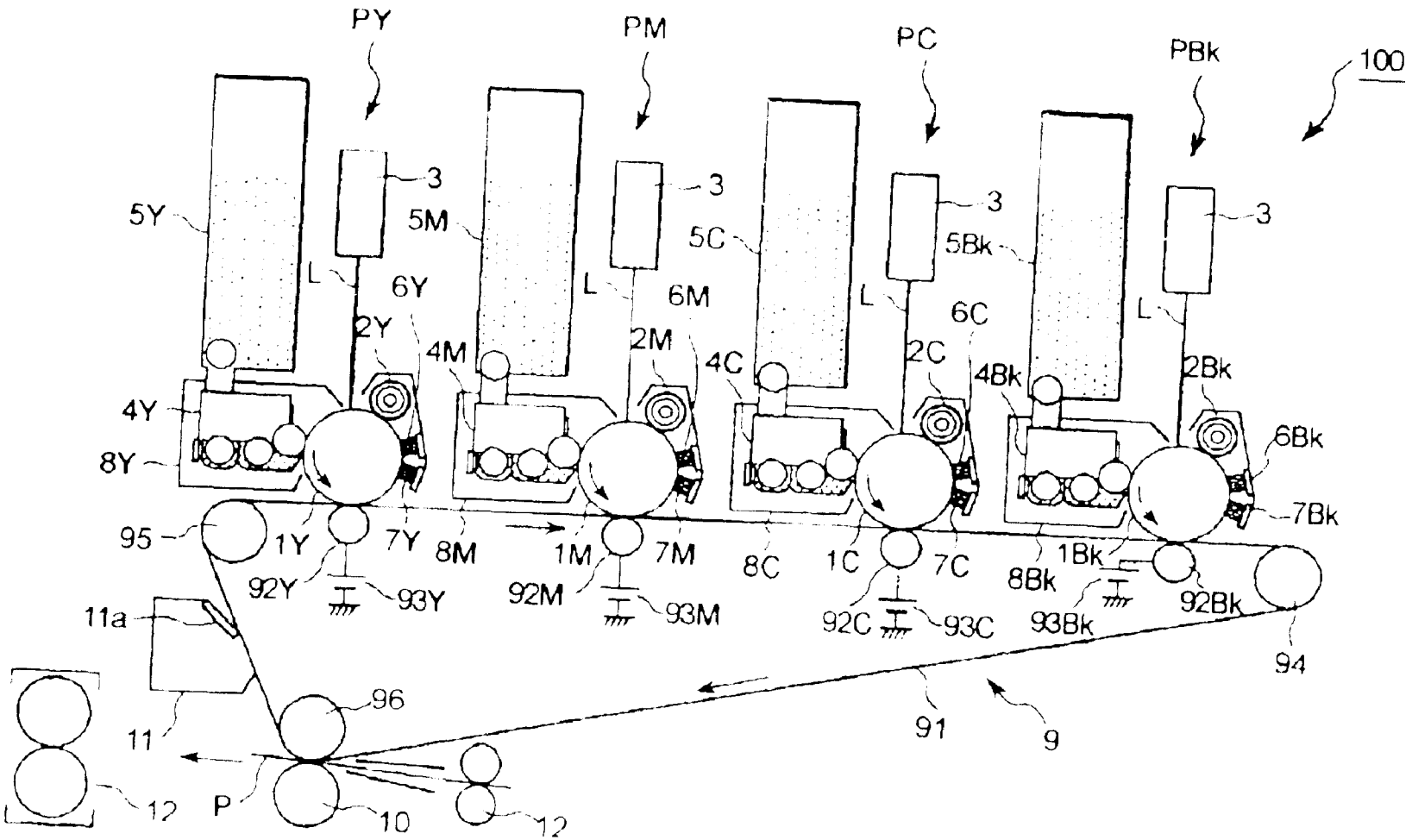
FIG. 1 is a schematic sectional view of an embodiment of the image forming apparatus according to the present invention.

FIG. 1 shows a schematic sectional view of an embodiment of the image forming apparatus according to the present invention.

Referring to FIG. 1, an image forming apparatus 100 of this embodiment is a color laser (beam) printer (maximum paper feeding size: A3) using a transfer-type electrophotographic process, a contact charging scheme and a reverse development scheme. Based an image information from an external host connected to a main body of the image forming apparatus so as to be capable of being communicated therewith, a full-color image is formed and outputted onto an image receiving member, such as a sheet, an OHP sheet or cloth.

The image forming apparatus 100 includes a plurality of process cartridges 8, as image forming station, each comprising an image bearing member, a charging means, a developing means, a first auxiliary charging means, and a second auxiliary charging means. The image forming apparatus 100 is a serially arranged four-drum type (incline) image forming apparatus wherein color toner images are once successively transferred onto an intermediary transfer belt (member) 91, as an image receiving member, in superposition manner by each process cartridge 8 and then are simultaneously transferred onto a transfer material P. The process cartridge 8 are disposed in series in a movement direction of the intermediary transfer belt 91 in the order of those for yellow (8Y), magenta (8M), cyan (8C) and black (8Bk).

In this embodiment, the respective image forming stations PY, PM, PC, PBk being image forming means for yellow (Y), magenta (M), cyan (C) and black (Bk), respectively, have the same structure except for the color of a developer used. Accordingly, in the following description, the image forming stations unless otherwise specifically.

The entire operation in the case of forming a four color-based, full-color image will be described.

In accordance with a signal from an external host apparatus which is connected to the image forming apparatus 100 so as to be capable of being communicated therewith, a color-separated image signal is generated. Based on this signal, the respective color toner images are formed in the respective process cartridges 8Y, 8M, 8C and 8Bk of the respective image forming stations, PY, PM, PC and PBk. In each of the process cartridges 8Y, 8M, 8C and 8Bk, a photosensitive drum 1 as the image bearing member is electrically charged by a charge roller 2 as the charging means and the uniformly charged surface of the photosensitive drum 1 is subjected to scanning-exposure by an exposure means 3 to form an electrostatic latent image on the photosensitive drum 1. The electrostatic latent image is supplied with toner as a developer by a developing device 4 as the developing means to visualize a developer (toner) image. The resultant color developer images formed on the respective photosensitive drums 1 are successively transferred in a superposition manner onto the intermediary transfer belt (member) 91. The resultant color toner images formed on the intermediary transfer belt 91 are simultaneously transferred onto the transfer material P conveyed to a secondary transfer station between the intermediary transfer belt 91 and a secondary transfer roller 10, as a secondary transfer means, disposed opposite to each other. Then, the transfer material P is carried to a fixing means 12 by which the toner image is fixed on the transfer material P, and is discharged out of the apparatus. Incidentally, the first and second auxiliary charging means will be described later.

Figure 2:
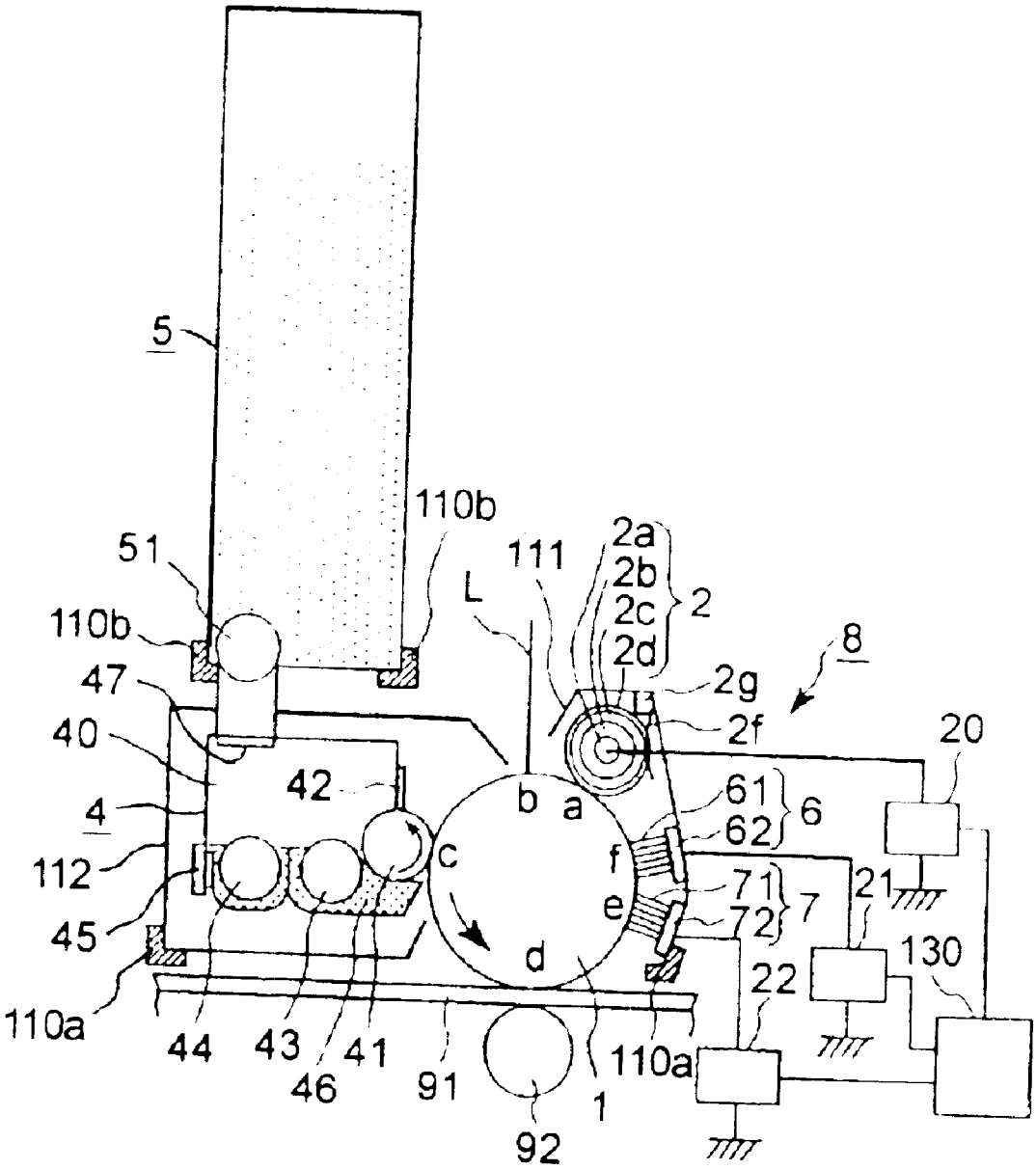
FIG. 2 is a schematic sectional view of a process cartridge to be incorporated in the image forming apparatus shown in FIG. 1.

Hereinbelow, the respective members or elements of the image forming apparatus 100 will be described more specifically with reference to FIGS. 1 and 2.

The image forming apparatus 100 includes a rotation drum-type electrophotographic photosensitive member (photosensitive drum) 1 as the image bearing member. In this embodiment, the photosensitive drum 1 is an organic photoconductor (OPC) drum having an outer diameter of 50 mm and is rotationally driven about a center axis at a process speed (peripheral speed) of 100 mm/sec in a counterclockwise direction indicated by an arrow. The photosensitive drum 1 includes an aluminum cylinder (electroconductive drum support) a surface of which is successively coated with three layers comprising an undercoat layer for suppressing light interference to improve adhesiveness to an overlying layer, a photocharge generation layer and a charge transport layer (thickness: 20 $\mu$m) in this order (from the aluminum cylinder side).

In this embodiment, the image forming apparatus 100 includes the charge roller 2 being a contact charger as the charging means. By applying a predetermined voltage to the charge roller 2, the photosensitive drum 1 is uniformly negatively charged. The charge roller 2 had a longitudinal length of 320 mm and included a core metal (support member) 2*a* on which three layers comprising an underlying layer 2*b*, an intermediary layer 2*c* and a surface layer 2*d* are formed in this order successively. The underlying layer 28 is a foamed sponge layer for reducing charge noise, the intermediary layer 2*c* is a resistance layer for attaining a uniform resistance as the entire charge roller 2, and the surface layer 2*d* is a protective layer for preventing an occurrence of leakage even when there is a defect such as pinhole on the photosensitive drum 1. In the charge roller 2 in this embodiment, a 6 mm-dia. stainless steel round bar was used as the core metal 2*a*, and the surface layer was comprised of a fluorine-containing resin and carbon black dispersed therein. The charge roller 2 had an outer diameter of 14 mm and an electric resistance of $10^4$–$10^7$ ohm.

The core metal 2*a* of the charge roller 2 is rotatably held by a bearing member at each of both end portions and is pressed toward the direction of the photosensitive drum 1 by a pressing spring to be pressed against the surface of the photosensitive drum 1 at a predetermined pressing force. Further, the charge roller 2 is rotated by the rotation of the photosensitive drum 1. Then, a predetermined oscillation voltage (charge bias voltage Vdc+Vac) comprising a DC voltage superposed with an AC voltage of a predetermined frequency is applied to the charge roller 2 through the core metal 2*a*, thus charge-treating the peripheral surface of the rotating photosensitive drum 1 so as to have a predetermined potential. The charge roller 2 contacts the photosensitive drum 1 at a charge portion a.

In this embodiment, the charge bias voltage applied to the charge roller 2 is an oscillation voltage comprising a DC voltage of −500 V superposed with a sinusoidal-wave AC current of a frequency of 1150 Hz and a peak-to-peak voltage Vpp of 1400 V. The peripheral surface of the photosensitive drum 1 is uniformly charged to a dark potential Vd of −500 V. In the case of applying the drive voltage to the charge roller, toner adhesion is not readily caused to occur, so that a stable charging performance can be attained.

Further, the charge roller 2 is provided with a charge roller cleaning member 2*f* comprising a flexible cleaning film 2*f*. The cleaning member (film) 2*f* is disposed in parallel with the charge roller 2 in its longitudinal direction and is also fixed to a supporting member 2*g*, which effects a certain degree of reciprocation motion in the longitudinal direction, at one end of the member 2*f* so that the surface of the member 2*f* creates a contact nip with the charge roller 2 in the vicinity of its free end. The supporting member 2*g* is driven through a gear train by a drive motor of the image forming apparatus 100 to effect a certain degree of reciprocation motion in the longitudinal direction, so that the charge roller 2 is rubbed with the cleaning film 2*f*. By doing so, adhesive contamination (fine powder toner, an external additive, etc.) is removed from the surface layer 2*d* of the charge roller 2.

The photosensitive drum 1 is, after being uniformly charge-treated to the predetermined polarity and potential, subjected to imagewise exposure to light L by an imagewise exposure means (such as a color separation and image formation exposure optical system of color original image, or a laser scanning exposure system for outputting a laser beam which is modulated corresponding to a time-series electric digital pixel signal on image information), whereby electrostatic latent images of color components corresponding to the respective image forming stations PY, PM, PC and PBk for objective color images are formed. In this embodiment, a laser beam scanner 3 using a semiconductor laser is used as the exposure means. The laser beam scanner 3 outputs laser light modulated in correspondence to the image signal sent from a host apparatus such as an image reader (not shown) to the image forming apparatus 100, thus effecting laser scanning exposure (imagewise exposure) of the uniformly charged surface of the rotating photosensitive drum 1. An electric potential at a portion of the photosensitive drum 1 surface irradiated with the laser light L is lowered by the laser scanning exposure, whereby an electrostatic image corresponding to the scanning-exposed image information is formed on the photosensitive drum 1 surface. In this embodiment, the exposure part potential V1 was set to −150 V, an irradiation position of the image exposure light L on the photosensitive drum 1 is an exposure portion b.

Then, the electrostatic latent image formed on the photosensitive drum 1 is developed with toner by the photosensitive drum 4 as the developing means. In this embodiment, the developing device 4 is a two component-type contact developing device (two component-type magnetic brush developing device). The developing device 4 includes a developer container (developer main body) 40; a developing sleeve 41, as a developer carrying member, having a developer regulating blade 42, as a developer-regulating member, having a magnet roller disposed within the developing sleeve 41; a two component developer (developer) 46 contained in the developer container 40 and principally comprising a mixture of resinous toner particles (toner) and magnetic carrier particles (carrier); and developer stirring members 43 and 44.

The developing sleeve 41 is disposed rotatably in the developing container 40 while externally exposing a part of its peripheral surface. To the developing sleeve 41, the developer-regulating blade 42 is disposed oppositely with a predetermined gap and forms a thin layer of the developer on the developing sleeve 41 by the rotation of the developing sleeve 41 in a direction indicated by an arrow within the developing sleeve 41.

In this embodiment, the developing sleeve 41 was disposed opposite and close to the photosensitive drum 1 while keeping the closest distance (S-D gap) of 350 μm. The opposing portion between the photosensitive drum 1 and the developing sleeve 41 is a developing portion c.

Further, the developing sleeve 41 is rotationally driven in a direction opposite from the advance direction of the photosensitive drum 1 at the developer portion c. The developer layer or the developing sleeve 41 contacts the surface of the photosensitive drum 1 at the developing portion c, to thus appropriately rub the photosensitive drum 1. To the developing sleeve 41, a predetermined developing bias voltage is applied from a power supply (not shown) as a voltage application means. In this embodiment, the developing bias voltage comprises an oscillation voltage including a DC voltage (Vdc) superposed with an AC voltage (Vac), more specifically including a Vdc of −350 V and a Vac of 1800 V (Vpp: peak-to-peak voltage) and a frequency of 2300 Hz.

The toner which is coated on the rotating developing sleeve 41 in the thin layer and conveyed to the developing portion c, is selectively adhered to the electrostatic latent image formed on the photosensitive drum 1 by an electric field created by the developing bias voltage, whereby the latent image is developed as a toner image. In this embodiment, the toner is adhered to the exposure (light) part on the photosensitive drum 1 to reversely develop the electrostatic latent image. The developer layer on the developing sleeve 41 after being passed through the developing portion c is returned to a developer reserve portion within the developer container 40 by a subsequent rotation of the developing sleeve 41.

Further, within the developing device 4, stirring screws 43 and 44 as the developer stirring members are disposed. The stirring screws 43 and 44 has a function of imparting a predetermined charge (potential0 to the toner by being rotated in synchronism with the rotation of the developing sleeve 41 to stir and mix a replenished toner with the carrier. Further, the stirring screws 43 and 44 convey the developer in mutually opposite directions with respect to the longitudinal direction, so that these stirring screws 43 and 44 have a function of supplying the developer 46 to the developing sleeve 41 and also conveying a part of the developer 46 decreased in toner concentration (a proportion of toner within the developer) to a toner replenishing portion in the developing process to circulate the developer within the developer container 40.

At a wall surface upstream from the screw 44 within the developing device 4, a sensor 45 for detecting a change in permeability of the developer to determine the toner concentration in the developer 46 is disposed. At a portion somewhat downstream from the sensor 45 in the developer circulating direction, a tone replenishing opening 47 is disposed. After the developing operation, the developer 46 is carried to the sensor 45 portion, where the toner concentration is detected. Based on the detected result, in order to keep the toner concentration in the developer 46 constant, a toner replenishing operation is appropriately performed by supplying the toner from a developer replenishing container (toner replenishing unit) 5 via the toner replenishing opening 47 of the developing device 4 through rotation of a screw 51 provided to the toner replenishing nit 5 connected to the developing device 4. The replenished toner is carried by the stirring screw 44 and mixed with the carrier, and after being provided with an appropriate charge, is carried to the vicinity of the developing sleeve 41, followed by formation in a thin layer on the developing sleeve 41 to be subjected to development.

In this embodiment, the toner used is a negatively chargeable toner having an average particle size of 6 μm, and the carrier used is a magnetic carrier having a saturation magnetization of 205 emu/cm$^3$ and an average particle size of 35 μm. The developer used has a mixing ratio (toner: carrier) of 6:94, and the toner subjected to development on the photosensitive drum 1 has a charge amount of −25 μC/g.

The intermediary transfer unit 9 as the transfer means is disposed opposite to the respective photosensitive drums 1 of the image forming stations PY, PM, PC and PBk. The intermediary transfer unit 9 comprises an endless intermediary transfer belt (member) 91 as the image receiving member which is extended around a drive roller 94, a tension roller 95 and a secondary transfer opposing roller 96 under a predetermined tension, and is moved in a direction indicated by arrows.

The toner image formed on the photosensitive drum 1 enters the primary transfer nip portion (transfer portion) d as the opposing portion between the photosensitive drum 1 and the intermediary transfer belt 91. At the transfer portion d, a primary transfer roller 92 as a primary transfer means is abutted against the back surface of the intermediary transfer belt 91. To each primary transfer roller 92, a primary transfer bias power supply 93 as the voltage application means is connected so as to allow application of the primary transfer bias voltage independently in the image forming stations PY, PM, PC and PBk. Onto the intermediary transfer belt 91, the yellow toner image formed on the photosensitive drum 1 is transferred by the above-mentioned operation in the image forming station PY for first color (yellow). Similarly, magnet, cyan and black toner images are successively transferred in the superposition manner in the respective image forming stations PM, PC and PBk by the corresponding photosensitive drums 1 after being subjected to the similar process.

In this embodiment, in view of transfer efficiency with respect to the toner transferred to the exposure portion (the exposure portion potential V1: −150 V), as the primary transfer bias voltage, a voltage of +350 V is applied for all the first to fourth colors. The four color toner images formed on the intermediary transfer belt 91 is then transferred simultaneously onto the transfer material P which is fed from an image receiving member supply means (not shown) and carried by a paper supply roller 12 as a conveyance means at a predetermined timing.

The transfer material P on which the toner images are transferred is then conveyed to a roller fixing device 12 as the fixing means, where the toner images are melt-fixed on the transfer material P under heating and pressure. Thereafter, the transfer material P is discharged out of the apparatus to provide a color print image.

The secondary transfer residual toner remaining on the intermediary transfer belt 91 is cleaned by a cleaning blade 11*a* as the cleaning means provided to an intermediary transfer belt cleaner 11 to prepare for a subsequent image forming process.

As the material for the intermediary transfer belt 91, in order to improve registration characteristic of the respective color image forming stations PY, PM, PC and PBk, an extendable material is not preferable. It is desirable to use a rubber belt having a core member of a resin or a metal, or a belt of a resin or a rubber. In this embodiment, a resinous belt which has a volume resistivity of the order of $10^8$ ohm.cm controlled by dispersing carbon black into PI (polyimide) is used. The belt has a thickness of 80 μm, a longitudinal length of 320 mm and an entire circumferential length of 900 mm.

As the primary transfer roller 92, an electroconductive sponge roller having a volume resistivity of not more than $10^6$ ohm.cm, an outer diameter of 16 mm and a longitudinal length of 315 mm.

The respective image forming stations PY, PM, PC and Pbk includes a second auxiliary charging brush 6 as the second auxiliary charging means and a first auxiliary charging brush 7 as the first auxiliary charging means, which are respectively abutted against the photosensitive drum 1. In this embodiment, both the second and first auxiliary charging brushes 6 and 7 comprises a brush member of electroconductive fiber. More specifically, the second auxiliary charging brush 6 includes an elongated electrode plate 62 provided with a brush portion 71. The brush portions 61 and 71 are abutted against the photosensitive drum 1 surface and are fixedly supported in substantially parallel with to the photosensitive drum 1 in its longitudinal direction (almost perpendicular to the surface movement direction).

The brush portions 61 and 71 of the second and first auxiliary charging brushes 6 and 7 are controlled in electric resistance by incorporating carbon black or metal powder in rayon fiber, acrylic fiber or polyester fiber. Each of the brush portions 61 and 71 may preferably have a mass of not more than 30 D (denier) and a density of $1\times10^4$–$5\times10^5$ fibers/inch$^2$. In this embodiment, each of the rush portions 51 and 71 are set to have a mass of 6D, a density of $1\times10^5$ fibers/inch$^2$, a length of fiber of 5 mm, and a volume resistivity of $6\times10^3$ ohm.cm. The auxiliary charging brushes 6 and 7 are abutted against the photosensitive drum 1 so that the respective brush portions 61 and 71 each provide a penetration of 1 mm to the surface of the photosensitive drum 1 and form an abutting nip width of 5 mm with the photosensitive drum 1.

Figure 3:
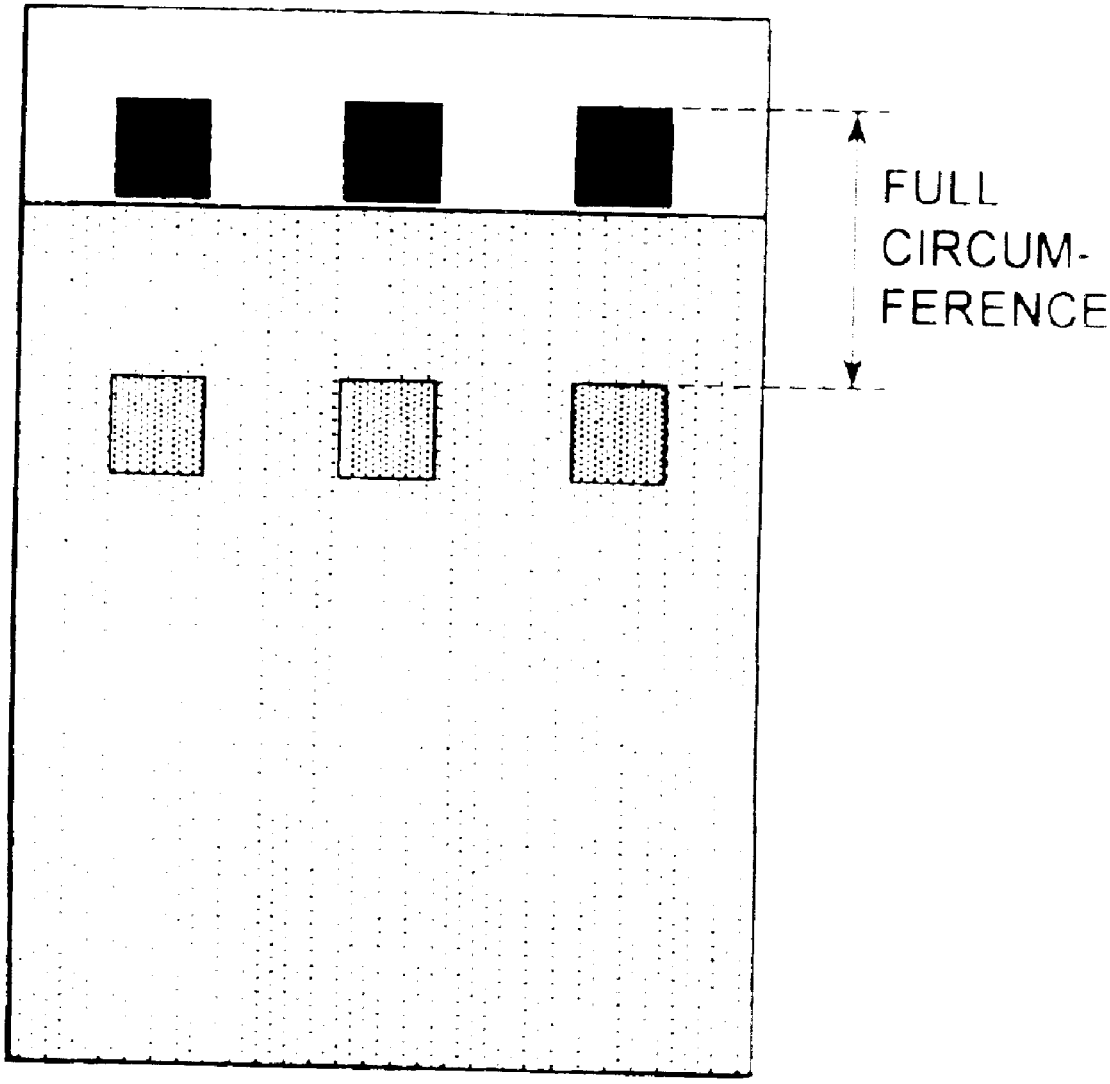
FIG. 3 is a view for illustrating a positive ghost image.

As shown in FIG. 3, in this embodiment, the first auxiliary charging brush 7 and the second auxiliary charging brush 6 are disposed downstream from the transfer portion d in the rotational direction of the photosensitive drum 1 and upstream from the charging portion a (in the rotational direction), in this order from the upstream side in the rotational direction of the photosensitive drum 1. The first auxiliary charging brush 7 and the photosensitive drum 1 form a contact portion e, and the second auxiliary charging brush 6 and the photosensitive drum 1 form a contact portion f.

As described in detail later, the first and second auxiliary charging brushes 7 and 6 are supplied with predetermined voltages from power supplies (as voltage application means) 22 and 21, respectively.

The voltage application means such as the power supplies (sources) 20, 21 and 22 provided to the image forming apparatus 100 are controlled by a control circuit 130, disposed within the image forming apparatus 100, as control means for effecting a centralized control of apparatus operation.

In this embodiment, the photosensitive drum 1, the charge roller 2, the charge roller cleaning member 2*f*, the developing device 4, the first auxiliary charging brush 7, the second auxiliary charging brush 6, etc., are integrally supported by a charging unit frame 111 and a development frame 112 to constitute a process cartridge 8. The process cartridge 8 is detachably mounted through mounting means 110*a* provided to the main body of the image forming apparatus 100. Further, in such a state that the process cartridge 8 is mounted in the image forming apparatus main body, drive means (not shown) disposed in the image forming apparatus main body and a driving force transmission means disposed on the process cartridge 8 side are connected with each other, thus placing the photosensitive drum 1, the developing device 4, the charge roller 2, etc., in a drivable state. Further, in the state, the various voltage application means, such as the power supplies 20, 21 and 22 for applying bias voltages to the charge roller 2, the second auxiliary charging brush 6, and the first auxiliary charging brush 7, respectively, and a power supply (not shown) for applying a bias voltage to the developing sleeve 41 are electrically connected through contacts respectively provided to the process cartridge 8 side an the image forming apparatus main body side. On the other hand, the toner replenishing unit 5 is detachably mounted to the developing device 4 and the image forming apparatus main body through mounting means 110*b*.

Next, the functions of the first and second auxiliary charging brushes 7 and 6 will be described more specifically.

On the photosensitive drum 1 after the transfer process, the residual developer (transfer residual toner) which has not been transferred onto the image receiving member is present. The transfer residual toner includes the negative-polarity toner at the image (forming) portion, the positive-polarity toner at the non-image (forming) portion, and the reversed toner which polarity is reversed into a positive polarity (opposite to the normal polarity) under the influence of the positive-polarity voltage applied in the transfer process.

In this embodiment, in order to enhance the toner recovery performance of the first auxiliary charging brush 7 with respect to such toners of the normal polarity and the opposing (reverse) polarity, conditions of voltages applied to the first auxiliary charging brush 7 are appropriately set, so that the transfer residual toner is recovered by the first auxiliary charging brush 7 to essentially prevent the toner from being sent to the abutting portion (charging portion) a between the charge roller 2 and the photosensitive drum 1.

In this embodiment, at the time of image formation, an AC voltage biased (superposed) with a DC voltage is applied from the power supply 22 to the first auxiliary charging brush 7.

By applying the AC voltage to the first auxiliary charging brush 7, it becomes possible to electrostatically improve the recovery performance of the transfer residual toner on the photosensitive drum 1. Further, by applying the DC voltage, of the polarity opposite to the normal polarity of the toner, superposed on the AC voltage as described above, to the first auxiliary charging brush 7, the electrostatic latent image on the photosensitive drum 1 is charged-erased to prevent the occurrence of positive ghost image. Incidentally, the voltages applied to the first auxiliary charging brush 7 will be described hereinafter in detail.

The second auxiliary charging brush 6 is supplied, from the power supply 21, with a voltage of the negative polarity identical to the normal polarity of the toner at the time of image formation, in order to prevent contamination of the charge roller 2 by the toner passing through the first auxiliary charging brush 7 in a slight amount. More specifically, as described above, in this embodiment, the first auxiliary charging brush 7 essentially recovers the transfer residual toner but it is difficult to completely recover (100% of) the transfer residual toner by the first auxiliary charging brush 7, thus leaving a slight amount of the transfer residual toner on the photosensitive drum 1. For this reason, the second auxiliary charging brush 6 is supplied with a DC of not less than −700 V (in terms of absolute value), i.e., not less than a discharge initiation voltage, whereby the transfer residual toner passing through the second auxiliary charging brush 6 is negatively (normally) charged due to sufficient discharge. The transfer residual toner passing through the second auxiliary charging brush 6 is readily charged to the negative polarity since the transfer residual toner is charged to the reverse polarity by the first auxiliary charging brush 7.

Thereafter, in the charging process at the charging portion a described above, the photosensitive drum 1 is subjected to charge treatment over the transfer residual toner but the transfer residual toner is not adhered to the charge roller 2 since the transfer residual toner is uniformly charged to the negative polarity by the second auxiliary charging brush 6. Further, by the alternating bias voltage applied to the charge roller 2, the charges of the transfer residual toner are appropriately removed to facilitate the recovery by the developing device.

Thereafter, exposure is performed over the transfer residual toner in the exposing process at the exposing portion b but, the amount of the transfer residual toner is slight, so that the exposure operation is not adversely affected by the transfer residual toner.

Further, the transfer residual toner, adhered to the non-exposure portion (non-image (forming) portion) on the photosensitive drum 1, which is not to be developed, is uniformly charged completely to the negative polarity and is appropriately charge-removed by the charge roller 2 to reduce a mirror force with the photosensitive drum 1. As a result, the transfer residual toner is recovered into the developing device 4 due to the above-mentioned relationship (fog removal potential difference Vback) between the surface potential of the photosensitive drum 1 (non-exposure portion potential: −500 V) and the DC component (−350 V) of the developing bias voltage.

As described above, in this embodiment, the developing sleeve 41 of the developing device 4 is rotated in the direction opposite from the advance direction of the photosensitive drum 1 at the developing portion c to rub the photosensitive drum 1 surface with the developer layer based on the developing sleeve 41 (contact-type, two component counter development scheme). This scheme has an advantage in recovery of the transfer residual toner on the photosensitive drum 1.

Hereinbelow, the voltage applied to the first auxiliary charging brush 7 will be described more specifically.

(I) Conditions of Voltage Application to First Auxiliary Charging Brush 7

(1) DC Voltage Application Condition

The DC voltage applied to the first auxiliary charging brush 7 was examined.

The first auxiliary charging brush 7 has not only the function of recovering the transfer residual toner but also the function of removing charges from the electrostatic latent image on the photosensitive drum 1. For this reason, a state of occurrence of positive ghost (image phenomenon) on the photosensitive drum 1 was examined by changing the applied DC voltage.

The results are shown in Table 1.

TABLE 1

| Applied voltage Vdc (V) | Positive ghost* |
|---|---|
| −150 | x |
| 0 | x |
| +100 | x |
| +150 | ○ |
| +200 | ○ |
| +250 | ○ |

*○: Did not occur.
x: Did occur.

As shown in Table 1, at the applied voltage of −150 V substantially equal to the surface potential of the photosensitive drum 1 after the transfer process, the first auxiliary charging brush 7 failed to remove the surface potential on the photosensitive drum 1 after the transfer process to cause an occurrence of the positive ghost phenomenon. In order to completely prevent the occurrence of the positive ghost phenomenon it was confirmed that the applied voltage (Vdc) of not less than +150 V was required.

The positive ghost phenomenon is, as shown in FIG. 3, such a phenomenon that in the case where an image which has a solid black portion and a solid white portion at its leading end and a uniform halftone image portion immediately below the solid portions is formed, a difference in image density between a position, at the halftone image portion, corresponding to one drum circumference after the position of the solid black portion (exposure part potential Vl) and a position, at the halftone image portion, corresponding to one drum circumference after the position of the solid white portion (non-exposure part potential Vd) is caused to occur, thereby to increase the image density at the former position.

As described above, the positive ghost phenomenon is caused when the non-exposure part potential Vd is not sufficiently lowered by the time of subsequent image formation. In this embodiment, the non-exposure part potential Vd is about −200 V after the transfer process since the non-exposure part potential Vd, after the charging process, of about −500 V is lowered (in absolute value) to about −200 V due to the application of positive-polarity voltage to the transfer roller. Similarly, the exposure part potential Vl after the transfer process is −150 V, so that the positive ghost phenomenon is caused to occur in the case of failing to sufficiently lower the non-exposure part potential Vd.

On the other hand, as is understood from the results of Table 1, when the DC voltage applied to the first auxiliary charging brush 7 was not less than +150 V, the occurrence of the positive ghost phenomenon was suppressed. In the image forming apparatus 100 according to this embodiment, it was found, on the basis of experiment, that the photosensitive drum 1 could be electrically charged by the first auxiliary charging brush 7 when the potential difference of about 300 V. In other words, it was found that a charge initiation voltage due to discharge or/and partial charge injection from the first auxiliary charging brush 7 to the photosensitive drum 1 was about 300 V. Herein, the charge initiation voltage refers to a potential difference of which the image bearing member 1, as the member to be charged, starts the charging when the DC voltage is applied to the charging means. It has been considered that, after the transfer process, the non-exposure part potential Vd is about −200 V and the exposure part potential Vl is −150 V, so that it becomes possible to decrease the difference in potential between the non-exposure part potential Vd and the exposure part potential Vl to prevent the occurrence of the positive ghost phenomenon.

Further, the DC voltage applied to the first auxiliary charging brush 7 is a positive-polarity voltage in view of not only the positive ghost phenomenon occurring on the photosensitive drum 1 but also the recovery performance since the transfer residual toner contains a large amount of toner having negative (triboelectric) charges.

When the toner is intended to be provided with a uniform negative (−) charge to some extent, the toner is once supplied with the positive (+) voltage by the first auxiliary charging brush 7 to be provided with the positive (+) charge since the toner having the positive (+) charges is liable to impart the negative (−) charges compared with the negative (−) toner having less charges. As a result, even when the toner passes through the first auxiliary charging brush 7, the charges of the toner is readily made negative and uniform by the second auxiliary charging brush 6 supplied with the negative (−) voltage.

From the above results, in this embodiment, the DC voltage applied to the first auxiliary charging brush 7 was set to +250 V.

(2) AC Voltage Application Condition

The recovery performance of the transfer residual toner was examined by changing the frequency and Vpp (peak-to-peak voltage) of the AC voltage applied to the first auxiliary charging brush 7. As a result, an optimum condition for remarkably enhancing the toner recovery performance of the first auxiliary charging brush 7 was found.

More specifically, the toner recovery performance of the first auxiliary charging brush 7 was evaluated in the following manner.

A solid image of 200% comprising 100% of yellow toner and 100% of cyan toner superposed on the yellow toner was printed (formed) on A3-sheet in an areal ratio of 3/4, and the cyan transfer residual toner was observed as to whether or not it was present, as a fog image, at a solid white portion after the solid color image. At this time, the first auxiliary charging brush 7 was superposed with the above-mentioned DC voltage of +250 V capable of preventing the positive ghost phenomenon.

The results are shown in Table 2.

TABLE 2

| | 300 Hz | 400 Hz | 500 Hz | 1000 Hz | 1500 Hz | 2500 Hz | 5000 Hz |
|---|---|---|---|---|---|---|---|
| 200 V | Δ | Δ | Δ | Δ | Δ | Δ | Δ |
| 300 V | Δ | ○ | ○ | ○ | ○ | ○ | ○ |
| 350 V | Δ | ○ | ○ | ○ | ○ | ○ | ○ |
| 400 V | Δ | ○ | ○ | ○ | ○ | ○ | ○ |
| 600 V | Δ | ○ | ○ | ○ | ○ | ○ | ○ |
| 900 V | Δ | ○ | ○ | ○ | ○ | ○ | ○ |
| 1000 V | Δ | ○ | ○ | ○ | ○ | ○ | ○ |

○: No fog of transfer residual toner at the solid white portion.
Δ: A slight fog of transfer residual toner occurred at the solid white portion.

From the results shown in Table 2, it was found that the frequencies and the Vpp values independently affected the transfer residual toner recovery performance. Incidentally, as a comparative embodiment, the similar experiment was performed without applying the AC bias voltage. As a result, toner fog was caused to occur. More specifically, particularly as in this embodiment, in the case of using the brush as the first auxiliary charging means, fog image of the transfer residual toner with brush mark was caused to occur.

Then, the frequency and Vpp of the AC voltage will be examined.

First, with respect to the frequency, a good toner recovery performance was attained at the frequency of not less than 400 Hz. The frequency value may be preferably be not less than 400 Hz since the toner recovery performance is achieved by application of the AC voltage but a slight fog image is liable to be caused to occur at a lower frequency level (300 Hz). This may be attributable to an occurrence of an intermittent operation of electrostatic adsorption and release at the lower frequency level, thus failing to provide a sufficient holding force into the brush portion 71 of the first auxiliary charging brush 7. In order to improve the recovery performance for the toner particles of both the polarities, it was clarified that a higher frequency to some extent was required. The upper limit of the frequency is considered to be about 5000 Hz. Above 5000 Hz, an excessive current passes through the brush, thus undesirably cause a problem of dielectric breakdown to pinhole(s) on the photosensitive drum.

With respect to Vpp (peak-to-peak voltage), it turned out that a sufficient toner recovery performance was attained when the Vpp value was not less than 300 V, more preferably not less than 350 V.

In order to electrostatically recover the toner particles of the normal and reverse polarities remaining on the photosensitive drum 1, as described above, it is assumed that it is effective to apply the AC voltage to the first auxiliary charging brush 7 so as to have both the positive and negative polarities. In other words, such a voltage that the first auxiliary charging brush 7 and the photosensitive drum 1 form an alternating electric field therebetween may preferably be applied to the first auxiliary charging brush 7. In this embodiment, the DC voltage of +300 V is applied to the primary transfer roller 92 as the transfer bias voltage, so that the non-image part potential (non-exposure part potential) Vd and the image part potential (exposure part potential) Vl, after the transfer process, become ca. −200 V and ca. −150 V, respectively. Accordingly, as the AC voltage to be applied to the first auxiliary charging brush 7, a Vpp value so as to create an alternating electric field relative to the surface potentials of −150 V to −200 V on the photosensitive drum 1 after the transfer process.

More specifically, the DC voltage applied to the first auxiliary charging brush 7 is +250 V, so that it is assumed that the Vpp value of the AC voltage is required to be not less than 900 V. When the Vpp value is set to about 900 V, the range of the voltage applied to the first auxiliary charging brush 7 is −200 V to +700 V. Accordingly, it is assumed that the resultant applied voltage has both polarities (positive and negative polarities) relative to the surface potential of the photosensitive drum 1 after the transfer process.

However, according to study of the present inventors, a good toner recovery performance has been attained when the Vpp value was actually not less than 350 V. The reason why the toner recovery performance is good in spite of the fact that the applied voltage does not have both polarities relative to the surface potential of the photosensitive drum 1 may be considered as follows although the following reason is not intended to restrain the present invention based on theory.

The surface potential of the photosensitive drum 1 is affected by discharge or charge injection from the first auxiliary charging brush 7 at a portion upstream from the rotational direction of the photosensitive drum 1 within the abutting nip e between the first auxiliary charging brush 7 and the photosensitive drum 1.

For example, in the case where the surface potential of the photosensitive drum 1 after the transfer process is in the range of −150 V to −200 V as described above, when a bias voltage comprising an AC voltage (Vpp) of 350 V superposed (biased) with a DC voltage of +250 V is applied to the first auxiliary charging brush 7, the applied voltage ranges from +75 V to +425 V. At this time, the charge initiation voltage of the first auxiliary charging brush 7 to the photosensitive drum 1 is about 300 V, so that it is assumed that the surface potential of the photosensitive drum 1 locally becomes +125 V at the instant when the voltage of +425 V is applied. Relative to the local surface potential of +125 V on the photosensitive drum 1, the applied voltage to the first auxiliary charging brush 7 varying in the range of +75 V to +425 V has both polarities (positive and negative). As a result, it is considered that the toner recovery performance of the first auxiliary charging brush 7 can be retained.

From the above results, in the case where the potential of the DC voltage applied to the first auxiliary charging brush 7 causes a potential difference of not less than the charge initiation voltage (300 V in the above embodiment) with respect to the surface potential of the photosensitive drum 1 after the transfer process, it is understood that it is necessary to apply Vpp which is not less than the charge initiation voltage of the first auxiliary charging brush 7 to the photosensitive drum 1. In the above experimental conditions, at the Vpp value of ca. 300 V which is not less than the charge initiation voltage of about 300 V, the effect of toner recovery was attained. Further, when the Vpp of 350 V is applied, the recovery performance was very good. By setting the Vpp as described above, it becomes always possible to recovery the toner particles of both polarities.

The toner recovery performance is improved by increasing the AC voltage applied to the first auxiliary charging brush 7 but application of an excessively high Vpp causes excessive passage of AC current through the brush, so that there is a possibility of an occurrence of dielectric breakdown to pinhole(s) on the photosensitive drums. Further, the excessively high Vpp causes a problematic noise made by the brush per se. In view of this problematic noise, the Vpp value may preferably be not more than 1000 V, more preferably not more than 600 V.

Therefore, in this embodiment, the frequency of the AC voltage applied to the first auxiliary charging brush 7 is set to 1150 Hz identical to the frequency of the AC component of the charge bias voltage applied to the charge roller 2, and the Vpp value is set to 400 V. Further, as the AC voltage waveform, a sinusoidal wave is employed since it has such an advantage that the amount of AC current is lower than a rectangular wave at the same Vpp value, thus not readily causing the problems in terms of brush noise and AC current. However, the AC voltage waveform may be any wave such as the rectangular wave or triangular wave.

In this embodiment, the alternating voltage comprising the AC voltage of the sinusoidal wave (Vpp: 400 V, frequency: 1150 Hz) superposed with the DC voltage of +250 V is applied.

According to the above-described application bias voltage conditions, under the AC voltage, the amount of the toner capable of being held by the first auxiliary charging brush 7 is remarkably increased compared with the case of applying only the DC voltage since the recovered toner particles tend to enter not only a portion of the brush portion 71 (of the brush 7) contacting the photosensitive drum 1 but also a portion closer to the support member of the brush 7.

As described above, according to this embodiment, the recovery performance of the transfer residual toner particles of both polarities by applying the AC voltage to the first auxiliary charging brush 7. In addition, by superposing the DC voltage on the AC voltage, it is possible not only to improve the negative-polarity toner in a larger amount but also to prevent the positive ghost phenomenon occurring on them photosensitive drum 1.

(II) Change in Coloring

Next, The above-mentioned change (fluctuation) in coloring was examined. An experiment for examining the case of inclusion of yellow toner into the cyan process cartridge 8C was conducted.

More specifically, the change in color was examined under such conditions that the printing ration at the upstream yellow image forming station PY was set to 40%, the printing ratio of the cyan image forming station PY in the movement direction of the intermediary transfer belt 91 was set to 10%, and a retransfer efficiency (in terms of a weight ratio of yellow toner, after being transferred onto the intermediary transfer belt 91, re-transferred at the transfer portion d of the cyan image forming station PC) was set to 0.6%.

Figure 4:
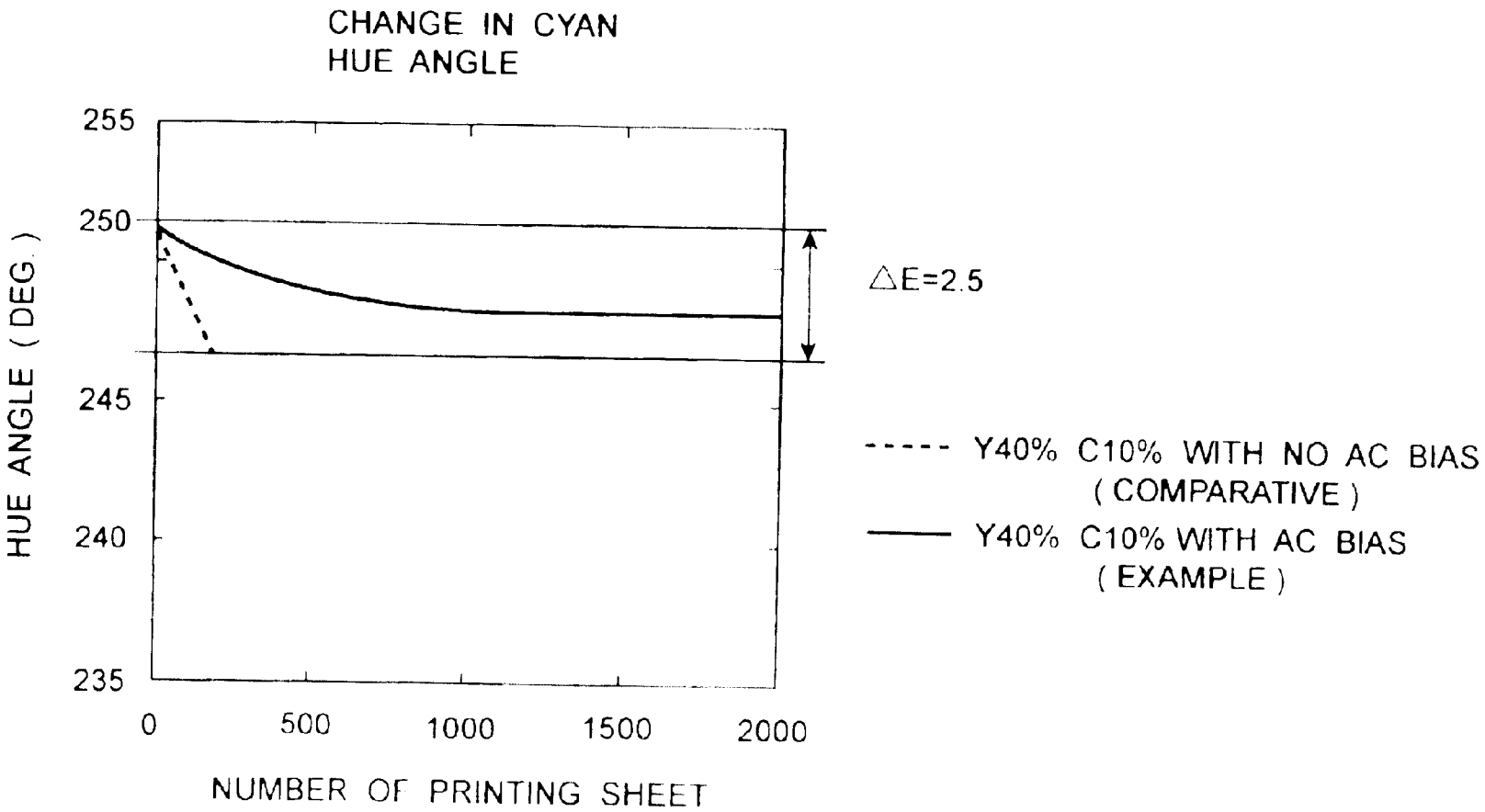
FIG. 4 is a graph showing an effect of preventing change in coloring).

The results are shown in FIG. 4.

In FIG. 4, the case of applying the AC voltage superposed with the DC voltage according to the above-described conditions (this embodiment) and the case of applying only the DC voltage without applying the AC voltage (comparative embodiment) are shown. The image forming apparatus used in the comparative embodiment had a structure identical to that of this embodiment. The changes in color of the two cases were compared by measuring a hue angle with a color meter.

As apparent from the results shown in FIG. 4, in the comparative embodiment in which the AC voltage was not applied to the first auxiliary charging brush 7, the cyan hue angle was abruptly changed with he number of printing (image forming) sheets. More specifically, a change in coloring ΔE was 2.5 which was at a visually recognizable level at 200 sheets of letter sheet.

On the other hand, in the image forming apparatus 100 of this embodiment wherein the AC voltage was applied to the first auxiliary charging brush 7, even after the image forming operation of 1000 sheets, the hue angle was not substantially changed, i.e., was at a level of practically no problem in terms of the change in coloring.

As described above, according to this embodiment, the AC voltage is applied to the first auxiliary charging brush 7 to improve the transfer residual toner recovery performance, whereby it becomes possible to prevent the change in coloring, which has been conventionally problematic, occurring the case of effecting repetitive image forming operation under such a condition that the printing ratio at the upstream station is higher than the downstream station.

(III) Toner Recovery Performance After Jamming

In a state that the developed toner image was adhered onto the photosensitive drum 1 and carried to the transfer portion, the charging performance (occurrence of charge failure) at the time of a subsequent image forming operation in the case of interruption of image forming operation due to jamming or sudden power failure was examined.

As a result, it was found that an occurrence of a defective image, such as a fog image due to charging failure at the time of the subsequent image forming operation was remarkably suppressed by applying the AC voltage to the first auxiliary charging brush 7 in accordance with the conditions of first embodiment described above even in such a situation that a large amount of the toner which had not been transferred at the transfer portion d was adhered to the photosensitive drum 1.

Conventionally, an occurrence of contamination of the charge roller 2 with the toner has been caused since the toner located at the transfer portion d is not transferred and sent to the abutting portion e, as it is, between the first auxiliary charging brush 7 and the photosensitive drum 1 and the toner is not sufficiently charged by the second auxiliary charging brush 6. On the other hand, according to this embodiment (first embodiment), the toner recovery performance of the first auxiliary charging brush 7 is improved, so that it is possible to prevent the occurrence of charge failure attributable to such a phenomenon that a large amount of the toner passes through the first auxiliary charging brush 7 and reaches the charge roller 2.

As described above, according to this embodiment, the transfer residual toner is recovered by the first auxiliary charging brush 7 so as not to essentially send the transfer residual toner to the charge roller 2 and the developing portion c. On the other hand, a part of the toner passing through the first auxiliary charging brush 7 is uniformly charged to the negative polarity being the normal polarity by the second auxiliary charging brush 6 to be prevented from adhering to the charge roller 2. Further, the toner passing through the second auxiliary charging brush 6 is appropriately charge-removed at the time of passing through the charge roller 2 to be readily recovered by the developing device 4.

As a result, it is possible to prevent the occurrence of image failure due to charge failure at the time of performing the subsequent operation of the image forming apparatus main body in the case where the image forming operation is interrupted by jamming or sudden power failure in such a state that the developed toner image is adhered onto the photosensitive drum 1 and is carried to the transfer portion d. Further, it is also possible to prevent the change in coloring, with the reliability which is caused to occur in such a case wherein an image having a higher printing percentage at the upstream station and a lower printing percentage at the downstream station is successively formed.

Incidentally, in order to retain the toner recovery performance of the first auxiliary charging brush 7 as described above, it is desirable that the toner recovered by the first auxiliary charging brush 7 is discharged at regular time intervals. Such a toner discharge operation can be performed during intervals between successive sheets, an initial operation when the image forming apparatus main body is turned on, or at the time of completion of the image forming operation. The voltage applied to the first auxiliary charging brush 7 may preferably be changed at a predetermined timing other than the time of image formation (at the time of an operation for forming an image to be recorded on the recording material and to be outputted).

As a specific method, it is possible to effect the toner discharge operation by applying a positive (+) DC voltage and a negative (−) DC voltage, respectively. As another method, the similar effect can be attained by applying a DC voltage of a polarity opposite from the polarity of the voltage applied to the first auxiliary charging brush 7, or by ON/OFF control of the positive DC voltage or the negative DC voltage in pulses. Further, e.g., in the case where a high printing ratio image which has been considered to generate a large amount of the transfer residual toner, is successively formed, the toner discharge operation can be performed during or after the series of image forming operation by controlling, e.g., the power supply 22 based on judgment depending on the image information signal or the operating situation of the image forming apparatus main body by the control means 130 for effecting the centralized control of the image forming apparatus.

In the case of the image forming apparatus using a monochrome developer, there is no problem even if the toner discharged from the first auxiliary charging brush 7 is recovered by the developing device 4. However, in the case of the image forming apparatus using a plurality of color developers, when the toner is discharged from the first auxiliary charging brush 7, it is preferable that recovery of the toner by the developing device 4 is not performed from the viewpoint of, e.g., prevention of color mixing. For example, the toner discharged onto the photosensitive drum 1 is caused to pass through the developing portion c by interrupting the rotation of the developing sleeve 41 or controlling the developing bias voltage so as to provide the same surface potential to the developing sleeve and the photosensitive drum. The toner passing through the developing portion c is transferred electrostatically or physically onto the intermediary transfer belt 9 at the transfer portion d, and then is recovered by the intermediary transfer belt cleaner 11.

As described above, according to this embodiment, the AC voltage is applied to the first auxiliary charging brush 7 to improve the recovery performance as to the toner on the photosensitive drum 1 after the transfer process. In addition, the DC voltage is applied to the second auxiliary charging brush 6 located downstream from the first auxiliary charging brush 7. As a result of the improvement in the toner recovery performance by the first auxiliary charging brush 7, even in the case where the image forming operation is interrupted by paper jamming or sudden power failure to increase the amount of the transfer residual toner, it is possible to present not only the contamination of the charge roller 2 but also the change in coloring due to gradual entry of the toner at the upstream station into the developing device 4 at the downstream station when the image formation is successively performed in the case where the printing ratio at the upstream station is higher than that at the downstream station. Further, with respect to the part of the toner which passes through the abutting portion between the first auxiliary charging brush 7 and the photosensitive drum 1 and reaches the charge roller 2, the DC voltage is applied to the second auxiliary charging brush 6 to uniformly charge the toner to its normal polarity, thus preventing the adhesion of the toner to the charge roller 2. Then, the toner passing through the charge roller 2 is caused to have an appropriate amount of charge, thus being recovered by the developing device 4. As a result, it is possible to prevent the toner from appearing on the subsequent image.

Incidentally, in the above embodiment, the image receiving member onto which the toners are transferred from the respective image forming stations PY, PM, PC, PBk is described as the intermediary transfer member. However, the present invention is not limited to this embodiment. As is well known in the art, there is an image forming apparatus including an image receiving member bearing member, such as a conveyance belt, for bearing and successively conveying an image receiving member, such as recording paper, instead of the intermediary transfer belt, to a plurality of image forming stations. In the image forming apparatus, toner images are successively transferred onto the image receiving member on the image receiving member bearing member from the respective image forming stations in the superposition manner, and then the image receiving member is separated from the image receiving member bearing member and conveyed to fixing means by which the unfixed toner image is fixed to provide a color image. The present invention is also equivalently applicable to such an image forming apparatus. In this case, similar as in the above embodiment, when the toner is appropriately discharged from the first auxiliary charging brush 7, the discharged toner is transferred from each of the respective image forming stations onto the image receiving member bearing member. The transferred toner can be removed by a cleaning means such as a cleaning blade for recovering the developer on the image receiving member bearing member.

The present invention is also applicable to a monochrome image forming apparatus which does not include the plurality of the image forming stations and directly forms an image by employing, e.g., the recording sheet (paper) as the image receiving member.

Incidentally, if a period for applying the AC voltage to the first auxiliary charging brush is set to be longer than a period in which the first auxiliary charging brush, the contamination of the photosensitive drum surface with the transfer residual toner is further effectively prevented.

Further, in the above embodiment, the first and second auxiliary charging brushes 7 and 6 are the fixed brush member but may be modified into desired members, such as a brush-type rotating member, an elastic roller and a sheet-like member.

Further, the image bearing member may be of direct injection charging type provided with a charge injection charging type provided with a charge injection layer having a volume resistivity of $10^9$–$10^{14}$ ohm.cm. Even in the case where the charge injection layer is not formed, the same effect can be obtained when, e.g., a charge transport layer has a volume resistivity in the above range. The image bearing member may be an amorphous silicon-type photosensitive member including a surface layer having a volume resistivity of, e.g., about $10^{13}$ ohm.cm.

Further, the flexible contact charging member may be, in addition to the charge rollers used in the for or material of fur brush, felt, cloth, etc. Further, it is possible to provide a charging member having appropriate elasticity, electroconductivity, surface properties and durability by using various materials in combination.

Further, as the waveform of the alternating voltage component (AC component, i.e., a voltage changed in voltage value periodically) of the oscillating electric field applied to the contact charging member or the developing member, it is possible to appropriately use, e.g., a sinusoidal wave, a rectangular wave or a triangular wave. The waveform may be a rectangular wave formed by periodically turning a DC power supply on and off.

Further, the imagewise exposure means as an information writing means to the charged surface of the photosensitive member as the image bearing member may be, e.g., a digital exposure means using a solid-state light emitting element array, such as LED, in addition to the laser scanning means used in the above embodiment. The exposure means may also be an analog-like imagewise exposure means using a halogen lamp or a fluorescent lamp as an original illumination light source. Accordingly, any means capable of forming an electrostatic latent image corresponding to image information can be applicable.

In the above embodiment, the normal polarity of the toner used is negative but may be positive.

What is claimed is:

1. An image forming apparatus, comprising:

an image bearing member;

charging means for charging said image bearing member;

developing means for developing an electrostatic latent image with a developer to form a developer image;

first auxiliary charging means, for charging a residual developer remaining on said image bearing member, disposed downstream from a transfer position where the developer image is transferred onto an image receiving member and upstream from said charging means, in a movement direction of a surface of said image bearing member; and second auxiliary charging means, for charging the residual developer, disposed downstream from said first auxiliary charging means and upstream from said charging means in the movement direction of the surface of said image bearing member;

wherein said first auxiliary charging member is supplied with a DC voltage of a polarity opposite to a normal polarity of the developer and with an AC voltage, and said second auxiliary charging member is supplied with a DC voltage of a polarity identical to the normal polarity of the developer.

2. An apparatus according to claim 1, wherein the AC voltage has a waveform comprising a sinusoidal wave.

3. An apparatus according to claim 1, wherein the AC voltage has a peak-to-peak voltage which is not less than a charge initiation voltage value between said image bearing member and said first auxiliary charging means.

4. An apparatus according to claim 1, wherein said auxiliary charging means is supplied with a superposed voltage of the DC voltage with the AC voltage so as to form an alternating electric field between said image bearing member and said first auxiliary charging means.

5. An apparatus according to claim 1, wherein the AC voltage has a frequency of not less than 400 Hz and not more than 5000 Hz.

6. An apparatus according to claim 1, wherein the AC voltage has a peak-to-peak voltage value of not less than 300 V and not more than 1000 V.

7. An apparatus according to claim 1, wherein the AC voltage has a frequency of not less than 400 Hz and not more than 5000 Hz and a peak-to-peak voltage value of not less than 300 V and not more than 1000 V.

8. An apparatus according to claim 1, wherein said developing means is capable of developing the electrostatic latent image formed on said image bearing member with a developer to form a developer image and also recovering the residual developer from said image bearing member.

9. An apparatus according to claim 1, wherein said charging means contacts said image bearing member to charge said image bearing member.

10. An apparatus according to claim 1, wherein said charging means is supplied with an oscillating voltage.

11. An apparatus according to claim 1, wherein said first auxiliary charging means includes an electroconductive fiber brush portion which contacts said image bearing member.

12. An apparatus according to claim 1, wherein the DC voltage applied to said first auxiliary charging means is switched to move the developer from said first auxiliary charging means to said image bearing member.

13. An apparatus according to claim 12, wherein the switching of the DC voltage applied to said first auxiliary charging means is performed by turning the DC voltage on and off.

14. An apparatus according to claim 12, wherein the switching of the DC voltage applied to said first auxiliary charging means is performed by changing a polarity of the DC voltage from the polarity opposite to the normal polarity of the developer to the normal polarity of the developer.

15. An apparatus according to claim 12, wherein the developer is, after being transferred from said first auxiliary charging means onto said image bearing member, recovered by said developing means.

16. An apparatus according to claim 12, wherein the developer is, after being transferred from said first auxiliary charging means onto said image bearing member, recovered by transfer means for transferring a developer image to said image receiving member at the transfer position.

17. An apparatus according to claim 16, wherein the developer is, after being transferred from said first auxiliary charging means onto said image bearing member, not recovered by said developing means.

18. An apparatus according to anyone of claims 1–17, wherein the apparatus includes a plurality of image forming stations each comprising said image bearing member, said charging means, said developing means, said first auxiliary charging means, and said second auxiliary charging means and further includes an intermediary transfer member as the image receiving member, said intermediary transfer member being moved opposite to each image forming station at which the developer image is transferred from an associated image bearing member onto said intermediary transfer member.

19. An apparatus according to claim 18, wherein each of the image forming stations forms a developer image different in color from each other.

20. An apparatus according to anyone of claims 1–17, wherein the apparatus includes a plurality of image forming stations each comprising said image bearing member, said charging means, said developing means, said first auxiliary charging means, and said second auxiliary charging means and further includes a bearing member for bearing the image receiving member, wherein said image bearing member is movable opposing to each of said image forming stations at which the developer image is transferred from an associated image bearing member onto the image receiving member borne by said image bearing member.

21. An apparatus according to claim 20, wherein each of the image forming stations forms a developer image different in color from each other.

* * * * *

UNITED STATES PATENT AND TRADEMARK OFFICE

CERTIFICATE OF CORRECTION

PATENT NO. : 6,963,707 B2
DATED : November 8, 2005
INVENTOR(S) : Masahide Kinoshita et al.

It is certified that error appears in the above-identified patent and that said Letters Patent is hereby corrected as shown below:

Drawings,
In Sheet 4, Figure 4, "SHEET" should read -- SHEETS --.

Column 1,
Line 56, "disadvantages" should read -- disadvantageous --.

Column 2,
Line 32, "o" should read -- of --.

Column 3,
Lines 10 and 11, "is" should read -- be --; and
Line 47, "o" should read -- of --.

Column 6,
Line 18, "an" should read -- on --.

Column 7,
Line 60, "a." should read -- a. --.

Column 9,
Line 34, "has" should read -- have --;
Line 35, "(potential0" should read -- (potential 0) --; and
Line 61, "nit" should read -- unit --.

Column 10,
Line 41, "is" should read -- are --.

Column 11,
Line 6, "includes" should read -- include --;
Line 11, "comprises" should read -- comprise --; and
Line 16, "to" should be deleted.

Column 12,
Line 33, "a" should read -- a --.

Column 13,
Line 4, "a" should read -- as --; and
Line 15, "b but," should read -- b, but --.

UNITED STATES PATENT AND TRADEMARK OFFICE

CERTIFICATE OF CORRECTION

PATENT NO. : 6,963,707 B2
DATED : November 8, 2005
INVENTOR(S) : Masahide Kinoshita et al.

It is certified that error appears in the above-identified patent and that said Letters Patent is hereby corrected as shown below:

Column 15,
Line 2, “is” should read -- are --.

Column 16,
Line 1, “cause” should read -- causing --.

Column 17,
Line 11, “recovery” should read -- recover --;
Line 53, “them” should read -- the --; and
Line 60, “ration” should read -- ratio --.

Column 18,
Line 14, “he” should read -- the --.

Column 19,
Line 22, “is” should read -- be --;
Line 43, “operation” should read -- operations --; and
Line 56, “is not” should read -- not be --.

Column 20,
Line 11, “present” should read -- prevent --.

Column 21,
Line 15, “for” should read -- fur --.

Signed and Sealed this

Eleventh Day of April, 2006

JON W. DUDAS
*Director of the United States Patent and Trademark Office*